United States Patent [19]

Carrington et al.

[11] Patent Number: 4,597,328

[45] Date of Patent: Jul. 1, 1986

[54] PRINT HAMMER FLIGHT TIME CONTROL SYSTEM

[75] Inventors: James E. Carrington, Vestal; Gerald R. Westcott, Endicott, both of N.Y.

[73] Assignee: International Business Machines Corporation, Armonk, N.Y.

[21] Appl. No.: 676,997

[22] Filed: Nov. 30, 1984

[51] Int. Cl.[4] ..... B41J 1/27

[52] U.S. Cl. ..... 101/93.13; 101/93.03; 101/93.14; 400/166

[58] Field of Search ..... 101/93.03, 93.14, 93.13; 400/157.3, 166

[56] References Cited

U.S. PATENT DOCUMENTS

| | | | |
|---|---|---|---|
| 3,845,710 | 11/1974 | Brodrueck | 101/93.14 |
| 4,384,520 | 5/1983 | Nakano et al. | 101/93.03 |
| 4,440,079 | 4/1984 | Dayger et al. | 101/93.03 |

OTHER PUBLICATIONS

IBM Technical Disclosure Bulletin, "Variable Control of Print Hammer on Time" by Gibb et al., vol. 24, No. 9, Feb. '82, pp. 4705–4706.

IBM Technical Disclosure Bulletin, "Print Hammer Flight Time Compensation" by Dayger, vol. 24, No. 1A, Jun. '81, pp. 18–19.

*Primary Examiner*—Edgar S. Burr
*Assistant Examiner*—John A. Weresh
*Attorney, Agent, or Firm*—Sughrue, Mion, Zinn, Macpeak, and Seas

[57] ABSTRACT

A hammer timing control system for the print hammers of a line printer uses a plurality of read/write RAMs in place of individual fire control circuits for controlling the firing periods of the hammers. A delay value RAM stores individual delay values to be interposed before each hammer is fired, and a terminate fire RAM stores a delay value to be interposed before the firing of a hammer is terminated. The hammers are turned on and turned off by signals incrementally clocked out from two pairs of RAMs which store each hammer address at memory locations corresponding to the hammer's assigned delay values.

8 Claims, 5 Drawing Figures

PRINT HAMMER FLIGHT TIME CONTROL SYSTEM

FIELD OF THE INVENTION

This invention relates to high speed printers and particularly to a control system for accomplishing improved registration of printed characters in an electromechanical printer system.

BACKGROUND OF THE INVENTION

In high-speed on-the-fly line printers a plurality of print hammers are usually arranged in a row and are selectively operated to strike the type faces on a constantly moving type carrier such as a revolving flexible band, belt, chain or train or a rotating drum. The type carrier is moving very fast, and good print registration requires that the hammers be controlled so that each print hammer is actuated to cause the hammer impact to occur exactly when the desired type face is aligned with the selected print hammer/print position. Furthermore, it is desirable to terminate the actuation of the print hammer after a specified actuation period.

The time period or flight time between hammer actuation and impact is different for each print hammer and also may vary during extended use. Numerous control means have been employed for incorporating variable delay circuits into the hammer firing circuits, whereby the hammers are individually controlled so that impact occurs at the exact time that the desired type face becomes aligned with the selected print hammer location.

BACKGROUND ART

U.S. Pat. No. 4,440,079 issued on Apr. 3, 1984 to Dayger et al discloses a control system for timing the hammers of impact printers. The hammer drivers are connected to individual fire control circuits which function to control the turn-on and turn-off times of each hammer driver. Thus, the flight time for each hammer can be independently set without affecting any other hammer flight times. Although such a system introduces an independent delay factor for each print hammer, it requires an exorbitant number of individual fire control circuits. Furthermore, the circuits must be individually adjusted for the desired delay factors and hammer actuation periods.

U.S. Pat. No. 3,183,830 issued May 18, 1965 to D. M. Fisher et al discloses a print registration control in which misregistration of printed characters is corrected by delaying the individual signals applied to respective hammer-operating solenoids. A variable one-shot circuit is provided for delaying the operation of a fixed delay one-shot circuit which controls the energization of the solenoid winding for a fixed time interval. A variable resistor which determines the discharge time of a capacitor is adjusted to alter the delay period of the variable one-shot circuit so that all printed characters in a line of print are in registration.

U.S. Pat. No. 3,872,788, issued Mar. 25, 1975 to Palombo describes a hammer flight time aligning system for impact printers wherein an individual variable delay circuit is introduced into the command input of each hammer of the printer. The delay time corresponds to the time period between the instant at which the logic control circuitry of the printer selects a hammer and the instant at which the hammer actuator in fact receives the energy necessary to release or actuate the hammer. The variable delay circuit includes a delay counter presettable to a predetermined delay count stored in a storage counter. The hammers are aligned by varying the individual hammer delay times so that the time period between hammer selection and hammer impact is the same for all hammers.

IBM Technical Disclosure Bulletin, Vol. 24, No. 1A, published in June 1981 by D. A. Dayger, discloses a print hammer flight-time compensation circuit for selectively delaying print hammer actuation to compensate for varying hammer flight times. A predetermined delay associated with each hammer address is stored in a delay address register. A compare circuit provides a select signal when a hammer at a particular address should be fired. The delay corresponding to this address is then retrieved from the delay address register. An actuation signal is sent to the hammer driver after the delay period has expired. After the hammer has been actuated, it is turned-off after a predetermined time interval by a hammer reset pulse.

U.S. Pat. No. 4,275,653 issued on June 30, 1981 to Bolcavage et al discloses a printer system comprising a belt printer controlled by a microprocessor. The microprocessor calculates when a belt position is aligned with the designated hammer print position, whereupon a hammer fire command is given. The fire command must first be addressed through a print position fire table which stores a predetermined delay period corresponding to the print position. This reference does not disclose fire control circuits for driving the hammers after a fire signal has been generated.

U.S. Pat. No. 4,286,516 issued Sept. 1, 1981 to H. Wertanen describes an electronic control for timing hammers which utilize digital logic circuitry which varies the timing of pulses that drive hammers in an impact printer. The control controls the timing of the firing pulse to each hammer by retarding it or advancing it from a nominal built-in time delay to compensate for differences in spacing between printed columns. Variations are made in the electrical circuitry to adjust the spacing. The electronic control includes a field-alterable preprogrammed read-only memory consisting of driver/decoding circuits connectable for feeding through a plurality of settable switches. The settable switches produce weighted on signals which, in combination with the counter-controlled multiplexer, control the timing of firing pulses from the multiplexer to selected print hammers. Adjustment in spacing is made by changing the setting of the switches and hence the weighting of the on signal. Drivers for the print hammer consist of one-shot multivibrators driving Darlington circuit devices to generate fixed width drive pulses.

IBM Technical Disclosure Bulletin Vol. 24, No. 9, published in February 1982 by R. E. Gibb and E. E. Lewis discloses a RAM used as a shift register or FIFO storage means. Hammer address data is stored in the RAM and accessed after a delay period to terminate the actuation of a hammer. A resettable counter is incremented by a clock and outputs the total number of clock pulses which have elapsed since the counter was reset. The RAM address ports are coupled to the counter output which, thus, dictates the current RAM storage location being accessed. A delay register stores the delay period. A comparator generates a counter reset signal when the counter output equals the value stored in the delay register, thereby limiting the number of RAM memory locations which can possibly be accessed. A hammer can be actuated after a delay period by storing the hammer address data in the RAM and then clocking through all the RAM storage locations until the hammer address data is accessed. The hammer address data is not stored at a particular RAM storage location representing the desired delay. The effective number of RAM shift register positions. within the RAM is changed to coincide with the delay period.

U.S. Pat. No. 4,317,412 issued on Mar. 2, 1982 to Bolcavage et al discloses a method and apparatus for testing the operating characteristics of a series of print hammers. The hammers are momentarily actuated in order to activate a feedback circuit which checks operating errors in the hammer firing mechanism. No provision is made to interpose a delay signal before hammer actuation.

U.S. Pat. No. 4,335,460, issued on June 15, 1982 to Bolcavage et al discloses a printer control means utilizing a parity check procedure for constantly monitoring data corresponding to the position and identity of a print character on a moving type belt. Thus, the position of a print character relative to the print hammers is known during the actuation and de-actuation of the print hammers. The parity information represents the print hammer to be actuated. This patent is directed to generating a hammer select signal when the type carrier is aligned with the print hammer, but does not address the problem of providing a variable delay period once a hammer select signal has been provided.

U.S. Pat. No. 4,376,411 issued on Mar. 15, 1983 to Carrington et al discloses a device for limiting the number of hammers which can be actuated during one print cycle. A hammer is actuated in response to a compare signal generated by a compare circuit indicating that print data on a type carrier is aligned with the hammer location. An adder adds the total number of compare signals. When the total number of compare signals equals a maximum value, a limit comparator generates a control signal which inhibits further comparisons by the compare circuit. This patent is directed to limiting the total number of hammers which can be actuated during a print cycle and does not disclose how each hammer is individually actuated.

U.S. Pat. No. 4,384,520, issued May 24, 1983 to Nakano et al discloses a device for controlling the solenoids of high speed printers. A memory stores data indicative of each hammer location on a print line, such that the hammer location can be read out in response to an output signal of a counter. This device does not store hammer location data at memory locations representing predetermined delay periods.

U.S. Pat. No. 4,457,229 issued on July 3, 1984 to Carrington et al discloses a control system which stores the type positions on a moving type band. Each type position is utilized to provide a signal indicative of when the character to be printed is aligned with the proper hammer location. This patent does not teach introducing a delay value in the hammer actuation signal path but, rather, presupposes some sort of hammer controls.

SUMMARY OF THE INVENTION

The electronic hammer timing control system of the present invention provides for automatic compensation of hammer flight time and for other print hammer controls without requiring a variable delay circuit for each hammer location. Basically, the hammer timing control system of the present invention comprises: a plurality of hammer driver circuits for driving the hammers against a type carrier in response to a hammer fire signal; hammer select means coupled in common to all of the hammer driver circuits for supplying, in response to control signals, a hammer address signal representing a particular hammer to be fired; circuit means, responsive to the hammer address signal, for supplying a hammer fire signal to the driver circuit of the particular hammer; signal generating means for generating an initiate fire signal when the type carrier is properly aligned with the hammer; and variable flight time control means, coupled to the hammer select means and to the signal generating means, for generating the control signals in response to the initiate fire signal, the control signals being designated as a first control signal representing the address of the hammer and a second control signal representing the timing of the hammer fire signal.

In the preferred embodiment, the hammer select means comprises an "even set" RAM, an "even reset" RAM, an "odd set" RAM and an "odd reset" RAM which function as shift registers for temporarily storing hammer address data. An "even" address register and and "odd" address register are coupled to the even and odd RAMs, respectively. These address registers have two purposes: (1) they clock into the RAMs the control signals representing the hammer to be fired and the timing of the hammer fire signal, and (2) they clock out the hammer address signals stored in the RAMs. The circuit means comprises a set and a reset decoder coupled in common to a plurality of latches. The set decoder decodes each hammer address signal and provides a set pulse to the corresponding latch which then provides its hammer driver with a hammer fire signal. After a predetermined period, the even or odd address register will clock out a hammer address signal from a reset RAM to the reset decoder which decodes the hammer address signal and provides a reset pulse to the corresponding latch which then turns off the hammer driver, thereby terminating the hammer fire signal.

The present invention advantageously provides means to effect a variable delay between the time when an initiate fire signal is generated and the time of actual hammer firing. Furthermore, this invention provides means to produce a variable length hammer fire signal. The signals driving the hammers emanate from a common print controller, thereby eliminating the need for a separate control circuit at each hammer driver. Thus, the invention is more economical, as less circuitry is required to provide the desired results. The reduction in circuitry also reduces the problem of system failure.

The subject matter of this invention is an improvement over the invention disclosed in U.S. Pat. No. 4,440,079 issued on Apr. 3, 1984 to Dayger et al and which is incorporated herein by reference. This patent shows a series of print hammers actuated by a control system which provides automatic flight time compensation.

DETAILED DESCRIPTION OF THE INVENTION

Figure 1:
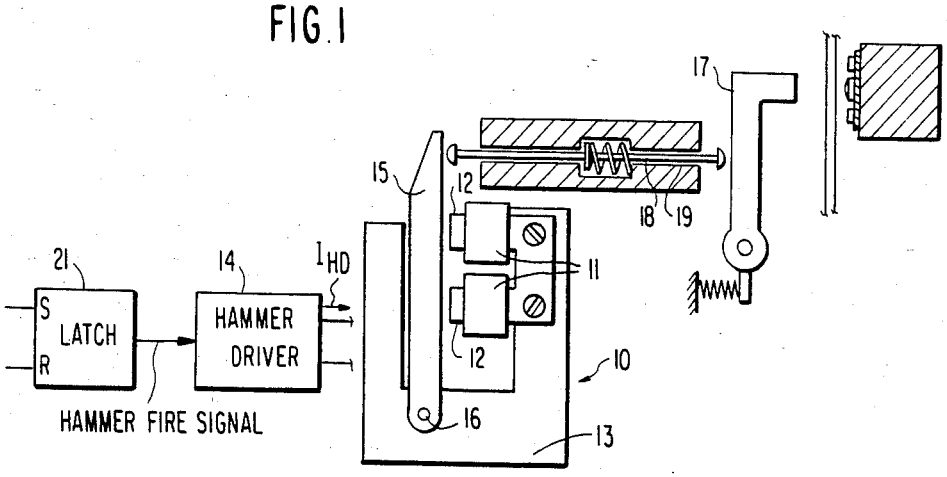
FIG. 1 is a schematic drawing of a printer mechanism and an electromagnetic print hammer useful with the control system of the invention.

FIG. 1 illustrates a print hammer mechanism for a single print position of a high speed printer and suitable for practicing the invention. The print hammer mechanism includes an actuator 10 consisting of coils 11 on poles 12 of a stationary magnetic core 13. Coils 11, when energized by current pulses $I_{HD}$ from a hammer driver circuit 14, drive an armature 15 pivoted at 16. The mechanical energy induced in armature 15 is coupled to a hammer 17 by means of a pushrod 18 disposed in guideway 19 of a block member.

Figure 2:
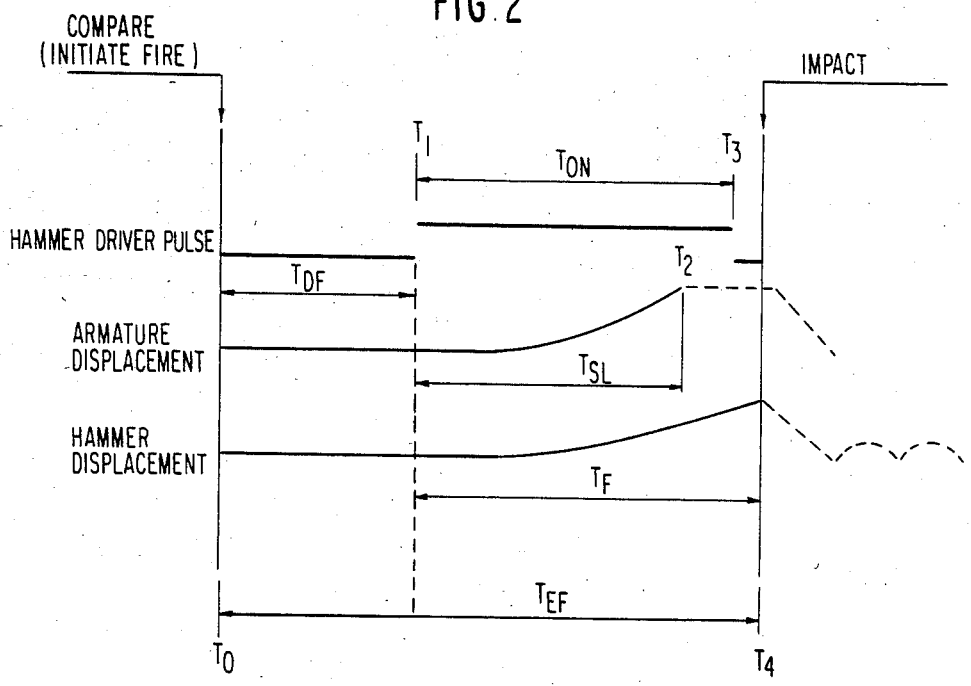
FIG. 2 is a timing diagram explaining the operation of the print hammer mechanism of FIG. 1.

FIG. 2 is a timing diagram showing the timing of the operation of the print mechanism of FIG. 1. The period from the instant the hammer driver 14 receives a hammer fire signal to the instant when hammer 17 is in the steady state reset position is referred to as the hammer-busy period. As shown in FIG. 2, the real hammer flight time $T_F$ is defined as the elapsed time from the instant hammer driver 14 receives the hammer fire signal to the instant impact occurs. The seal time $T_{SL}$ is the interval between the instant that driver 14 receives the hammer fire signal and the instant that armature 15 seals against poles 12 of core 13. During the interval $T_F$-$T_{SL}$ hammer 17 is in free flight. The hammer driver 14 is fired or turned on in accordance with this invention at $T_1$ which occurs at some variable delay time period $T_{DF}$ (first delay period) after the occurrence of an initiate fire signal at the time $T_0$. In the preferred manner of practicing the invention, the effective hammer flight time $T_{EF}$ is constant for all print hammers. The delay period $T_{DF}$ is variable and depends on the actual flight time characteristics of each hammer. Terminate fire time $T_3$ can be variable, but is the same for each hammer in the preferred embodiment and occurs a predetermined delay period (second delay period) after the initiate fire time $T_0$.

Figure 3:
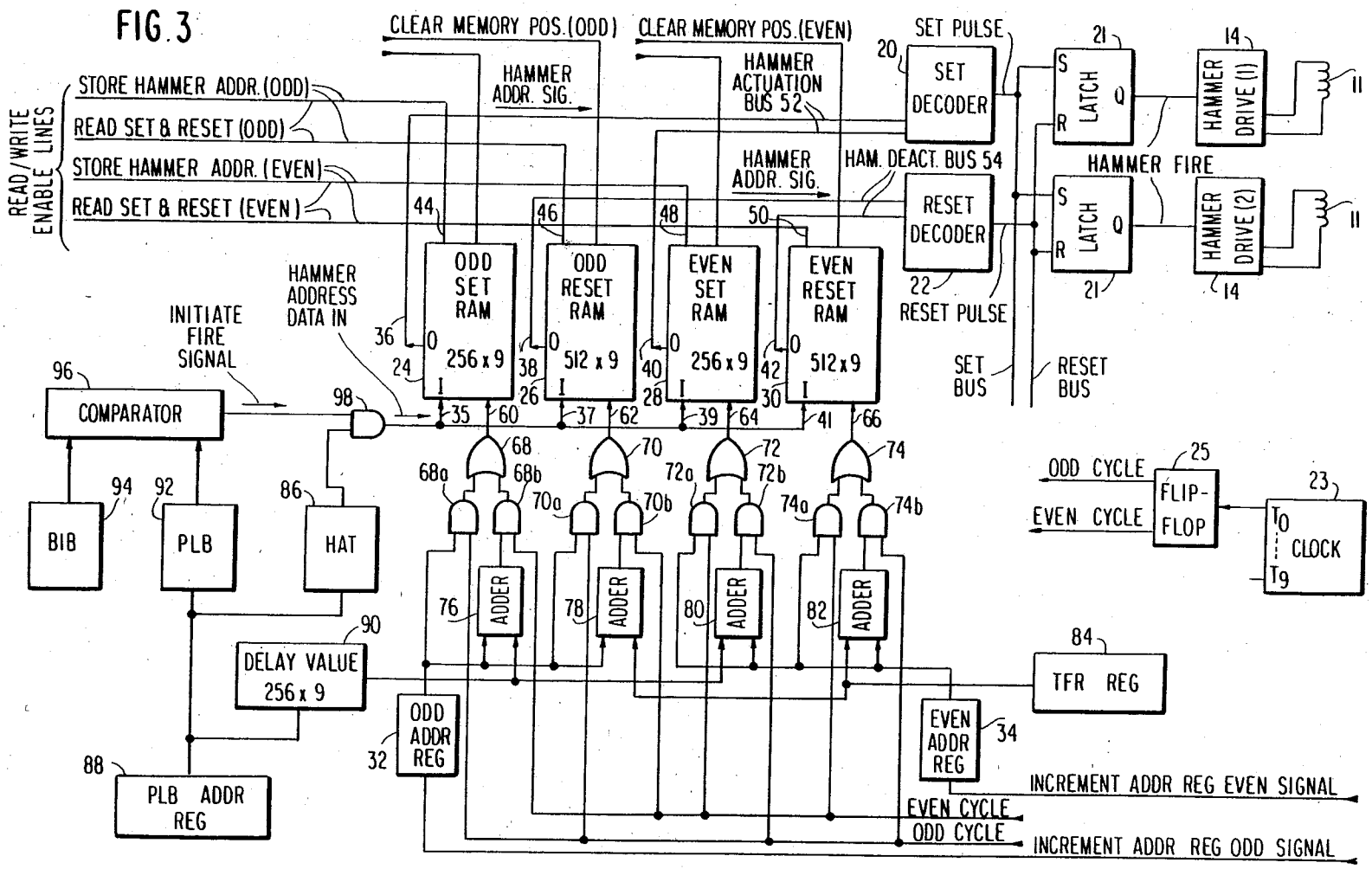
FIG. 3 is a schematic diagram of the preferred embodiment of the invention incorporating an electronic control system for controlling the timing of a plurality of print hammer mechanisms of the type shown in FIG. 1.
Figure 4:
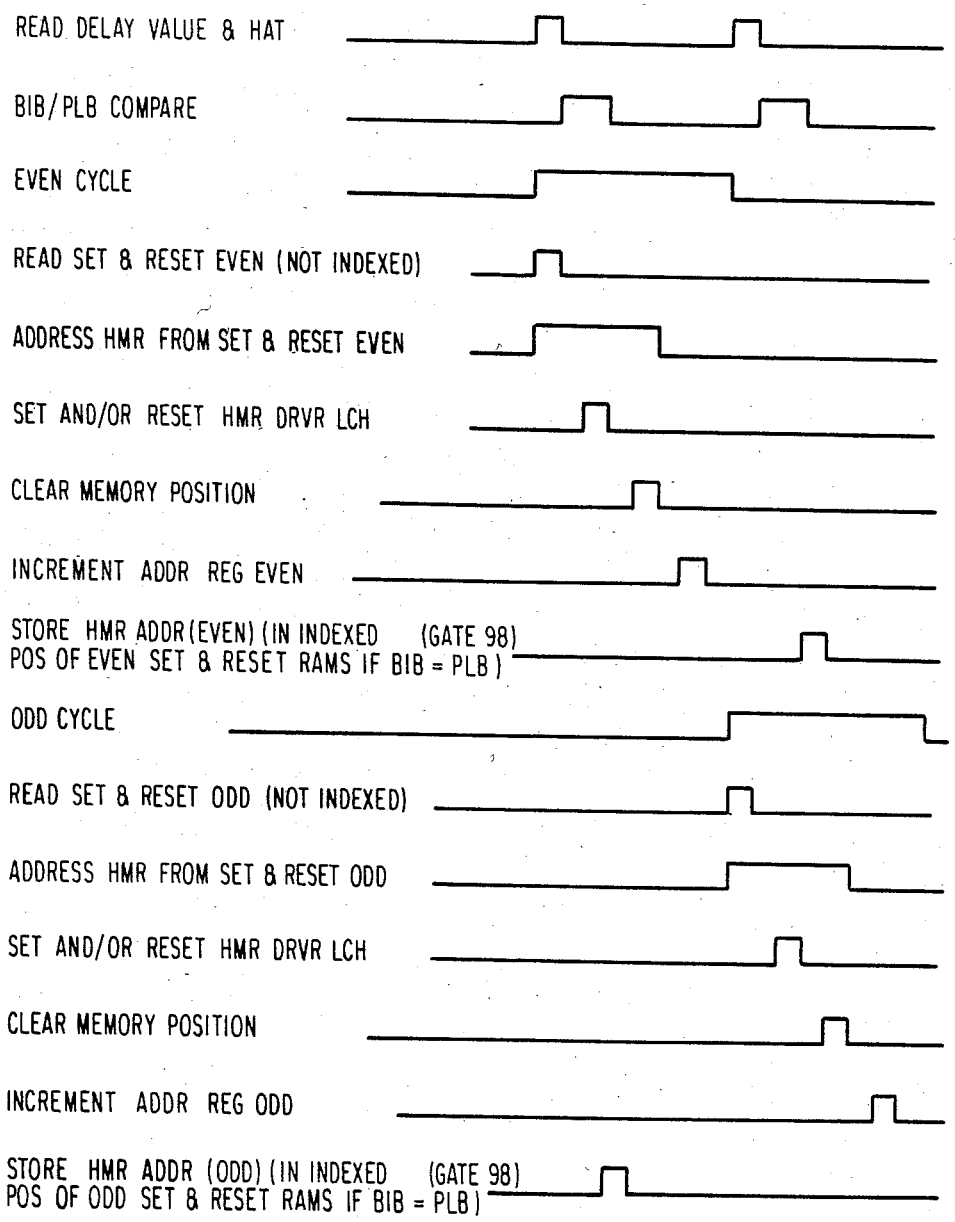
FIG. 4 is a timing diagram explaining the operation of the circuit shown in FIG. 3.

In a printer control system for a plurality of print hammers aligned in a row, the pairs of hammer actuating coils 11 in a row are connected to be energized by corresponding hammer driver circuits 14 which are operated in a predetermined order during a print operation. As shown in FIGS. 1 and 3, each hammer driver circuit 14 has a corresponding latch 21 which is connected to a common set decoder 20 and to a common reset decoder 22. The decoders decode hammer address signals from four read/wirte RAMs designated as odd set RAM 24, odd reset RAM 26, even set RAM 28 and even reset RAM 30. The RAMs function as shift registers for temporarily storing hammer address (position) data defined as a first control signal. The hammer address data is stored at specific RAM storage locations designated by a second control signal which represents the timing of the hammer fire signal. System timing pulses are generated by a suitable timing source, such as a free running clock 23, and function to synchronize all the components of the system. The time period in which each hammer 17 may be fired is defined as an option cycle. The clock 23 has ten outputs $T_0$–$T_9$ which supply timing signals $T_0$–$T_9$ to various circuit components of the system. The flip-flop 25, connected to output $T_0$, is toggled by $T_0$ timing pulses to generate even and odd cycle pulses which define the even option cycles and the odd option cycles (FIG. 4). During the even and odd option cycles, RAM storage locations are "optioned" or addressed. If the storage location contains a hammer address the address will be outputted as the respective hammer address signal. If the storage location does not contain a hammer address, no hammer address signal will be provided. The RAMs are addressed by address registers 32 and 34 which are incremented by appropriate even and odd cycle pulses as shown.

Hammer address data is stored in the odd set RAM 24 and the odd reset RAM 26 during the even option cycle. This data is read from these RAMs 24, 26 during the odd option cycle. Data is stored in the even set RAM 28 and the even reset RAM 30 during the odd option cycle. The data is read from these RAMs 28, 30 during the even option cycle.

The odd set RAM 24 and the even set RAM 28 provide the hammer address signals for firing the hammers. The odd reset RAM 26 and the even reset RAM 30 provide the hammer address signals for terminating the firing of the hammers. Two pairs (an even pair and an odd pair) of RAMs are necessary to provide one hammer address signal to each decoder during each even and odd cycle. During each even and odd cycle, data can be both read from one pair of RAMs and also stored or written into the other pair. FIG. 4 illustrates the relationship between the even and odd cycle times and the relative timing of operations within each cycle.

The storage locations in the odd RAMs 24, 26 are addressed by the odd address register 32, and the storage locations of the even RAMS 28, 30 are addressed by the even address register 34. Both address registers are reset at the beginning of each print line operation and then count up to "512", whereupon they "wrap around" to "1" and continue counting in this manner until the end of the print operation. Each address register has a 9 bit digital output. The set RAMs 24, 28 are coupled only to the eight least significant bits of their address register output and, thus, wrap around at a count of "256". The length of the set RAMs is shorter than the reset RAMs because the hammer Set Pulse occurs before the hammer Reset Pulse. Although FIG. 4 illustrates only one even and one odd cycle for addressing each RAM, it is clear that more than one hammer address are stored in each RAM at a given time, since even and odd cycles are continuously generated and a hammer address will be stored at the occurrence of each initiate fire signal.

The RAMs 24, 26, 28, 30 have input ports 35, 37, 39, 41 for writing or storing hammer address data in each RAM, and output ports 36, 38, 40, 42 for reading out hammer address signals. Each RAM has a read/write enable port 44, 46, 48 or 50 which can be accessed by write and read signals to make the RAM either store data or read it out. A hammer actuation bus 52 is coupled between the output ports 36, 38 and set decoder 20. The set decoder 20 is coupled in common to all of the latches 21 so that each hammer address signal from either set RAM 24 or 28 will be decoded to provide a set pulse to the corresponding latch which then fires its corresponding hammer driver 14. A de-actuation bus 54 and a reset decoder 22 operate in a similar manner to provide a latch reset pulse to terminate the hammer fire signal.

The set RAMs 24, 28 have 256 storage locations which are incrementally addressed by the address registers 32 and 34; therefore, after all 256 storage locations have been addressed, addressing continues beginning at location "1".

Hammer address data is stored in the odd set RAM 24 upon the occurrence of a Store Hammer Address (ODD) signal during the even option cycle. Hammer address data is stored in the even set RAM 28 upon the occurrence of a Store Hammer Address (EVEN) signal during the odd option cycle. The reset RAMS 26, 30 have 512 storage locations and are also incrementally addressed starting with the first storage location. Hammer address data is stored in the odd reset RAM 26 upon the occurrence of a Store Hammer Address (ODD) signal during the even option cycle. Hammer address data is stored in the even reset RAM 30 upon the occurrence of a Store Hammer (EVEN) signal during the odd option cycle.

The even RAMs 28, 30 and the odd RAMs 24, 26 are alternately read out upon the occurrence of the corresponding READ SET AND RESET (even and odd) signal and ADDRESS HAMMER FROM SET AND RESET (even or odd) signal during the respective option cycle times. When an addressed RAM storage location contains hammer address data, the corresponding decoder 20 or 22 will decode this data and provide the corresponding latch 21 with a set pulse or a reset pulse to turn on or turn off its hammer driver 14.

When hammer address data is read out of the set RAMs 24 or 28, the selected hammer will be fired. A CLEAR MEMORY POSITION signal now clears this RAM storage location, and an INCREMENT ADDRESS REGISTER signal increments the corresponding address register.

In order to fire a hammer with a predetermined delay, the hammer address (position) data is stored in a RAM location which will not be read out for a predetermined period. For example, hammer address data is stored in the odd set RAM 24 or the even set RAM 28 at a storage location determined by the present value of the corresponding odd or even address register 32 or 34 as indexed by a predetermined delay value, the sum of the present and delay values being the RAM storage location which will be read out from the RAM 24 or 28 only when the predetermined delay period has expired. Delay values for each hammer are stored in a delay value buffer RAM 90.

The READ/WRITE enable ports 44, 46, 48, 50 make the RAMs either read hammer address signals out of RAM storage locations determined by the two address register outputs applied to the RAM address ports 60, 62, 64, 66, or write (store) hammer address data into RAM storage locations determined by delay value from buffer 90 plus the present value of address registers 32 and 34 or register 84.

A plurality of OR gates 68, 70, 72 and 74 and AND gates **68*a*, 68*b*, 70*a*, 70*b*, 72*a*, 72*b* and 74*a*, 74*b* are coupled between RAMs 24, 26, 28 and 30 and a set of respective Adders 76, 78, 80 and 82 and also the respective address registers 32, 34. The outputs of the OR gates are coupled to the RAM address ports 60, 62, 64 and 66**, respectively, and determine which RAM locations are addressed.

Each OR gate has two inputs, one being coupled through an AND gate to the output of its corresponding adder, and the other being coupled through a second AND gate to one of the address registers. The OR gates with AND gates **68*b*, 70*b*, 72*b* and 74*b* function to apply the outputs of the Adders to the RAM address ports 60, 62, 64, 66 during the write (store) cycle when a hammer address is being stored in RAM storage locations representing the predetermined delays for turning on or off the corresponding hammer driver. The OR gates 68, 70 with AND gates 68*a* and 70*a* also function to apply the output of the ODD Address Register 32 to the odd set RAM 24 and to the odd RESET RAM 26 to sequentially address the RAM storage locations during odd cycles. The OR gates 72, 74 with AND gates 72*a* and 74*a* also function to apply the output of even address register 34 to the even set RAM 28 and to the even reset RAM 30** to sequentially address the RAM storage locations during even cycles.

The hammer drivers 14 are turned off after the second delay period in response to hammer address signals on de-actuation bus 54 from the odd reset RAM 26 or the even reset RAM 30. The turn-off or terminate fire time $T_3$ (second delay value) is stored in a programmable terminate fire (TFR) register 84. For example, a hammer address is stored in the odd reset RAM 26 at a storage location defined by the current value of the odd address register 32 as indexed by the value of the contents of the programmable termination fire register 84. Adder 78 adds these values to determine the odd reset RAM 26 storage location representing the time when the hammer fire signal is turned off.

In operation, a Print Line Buffer Address Register (PLB ADDR REG) 88 provides a signal when it is time for the next hammer in the line printer to be fired. This signal is simultaneously sent to the delay value buffer 90, a hammer address table (HAT) 86 and a print line buffer (PLB) 92. At this time, the first delay value for this particular hammer is read out from the delay value buffer 90 to the Adders 76 and 80, the corresponding hammer address (position) generated by HAT 86, and a signal is generated by PLB 92 to indicate that this particular hammer is ready to be fired. Firing of the hammer must wait until the desired type face of the type carrier is opposite the hammer to be fired. Furthermore, it is not possible to print a character at two adjacent hammer positions. In order to print a complete line, the PLB must institute a series of three sub-scans, for example, wherein every third hammer position is actuated during each sub-scan. A device which continuously monitors the relationship between a continuously moving set of type faces on a band-type carrier, the particular sub-scan, and each print hammer position during each sub-scan is disclosed in U.S. Pat. No. 4,457,229, issued on July 3, 1984 to Carrington et al. This device includes a PLB and a band image buffer (BIB).

The PLB 92 is loaded by the PLB Address Register 88 with the characters to be printed. The BIB 94 contains an electronic image of the characters on the type band and continuously outputs the digital value of the character adjacent the next hammer to be fired. The character data are read from the PLB and BIB each even and odd cycle and compared. An Initiate Fire signal is generated by comparator 96 when there is a match. This match indicates that the character on the type carrier to be typed at a specific hammer position is opposite that specific position. In accordance with the present invention, the first (turn-on) delay value is interposed between the generation of the Initiate Fire signal and the actual firing hammer. A comparator 96 compares the output of BIB 94, which represents the current position of a particular type face on the type carrier, to the output of PLB 92. A match or affirmative comparison produces the Initiate Fire signal which indicates that the next hammer position in this sub-scan is ready to be fired. This Initiate Fire signal is used to gate the hammer address data from HAT 86 through AND gate 98 and into either an even or odd pair of RAMs, depending upon whether an even or odd cycle is present, at RAM storage locations generated by the ADDERS 76, 78, 80 and 82. The timing diagram in FIG. 4 depicts the interrelationships among the aforementioned timing signals which occur during each even and odd cycle.

An example using hypothetical delay values for a specific character will illustrate the operation of the control system. Suppose the character to be printed is an "A" at hammer position (address) "10" which happens to have a corresponding first (hammer fire) delay value of "50" and a second delay value (Terminate Fire Time) of "100". Assume the corresponding address register is currently at a RAM location or address "75". Upon the occurrence of a match (Initiate Fire signal), the hammer address "10" is stored in a set RAM at storage location (50+75=125) and in the reset RAM storage location (100+75=175). Each RAM storage location is incrementally accessed by the address register. When the address register equals (125), the set RAM will read out the hammer address signal corresponding to hammer position "10" which is decoded by set decoder 20 which outputs a set pulse to a latch 21, causing a hammer driver circuit 14 to fire hammer position number "10". When the address register reaches (175), the reset RAM will read out the hammer address signal corresponding to hammer position "10" which is then decoded by reset decoder 22 which outputs a reset pulse to a latch 21, causing a driver circuit 14 to terminate the firing of hammer number 10.

Figure 5:
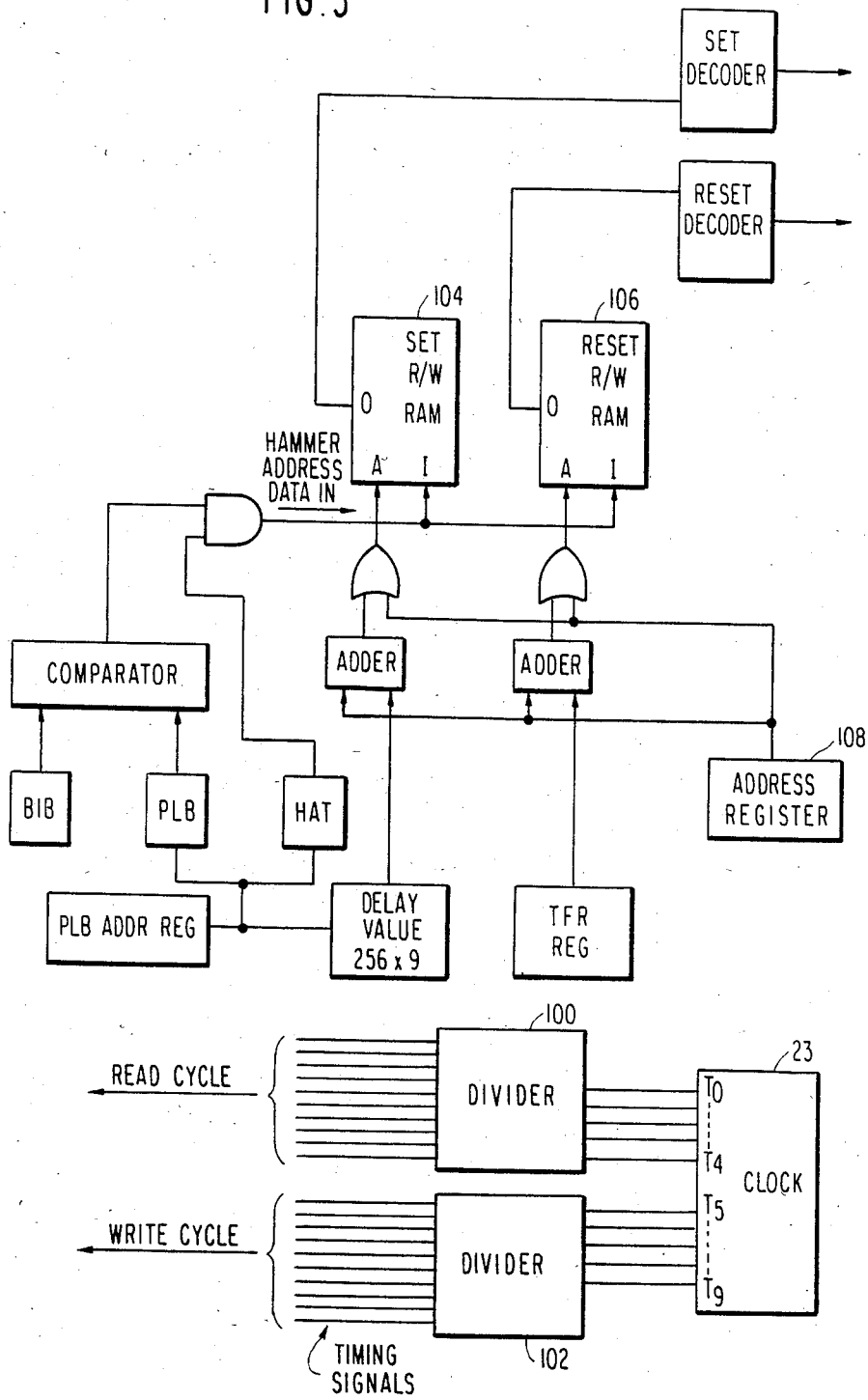
FIG. 5 is a schematic diagram of the second embodiment of the invention incorporating two Random Access Memory storage devices in place of the four described in the preferred embodiment.

In another embodiment (FIG. 5) for use with a slower printer speed and logic/memory speed, each option time (necessarily longer than either the even or odd option cycle of the preferred embodiment) is divided into a read and write cycle. The requirement of an even and odd cycle, and pairs of even and odd RAMs is eliminated when the printer speed is reduced. With shorter option times, limited logic memory speeds necessitate that one pair of RAMs read out hammer addresses while the other pair stores hammer addresses. Longer option times permit a RAM first to read out a hammer address and then store a hammer address, within a single option time.

The clock 23 provides five clock outputs $T_0$–$T_4$ corresponding to the read cycle and five outputs $T_5$–$T_9$ for the write cycle. These outputs are then passed through corresponding dividers 100, 102 which generate the requisite number of timing pulses to operate the system during a read and write cycle. One set R/W RAM 104 and one reset R/W RAM 106 replace the four RAMs 24, 26, 28, 30. One address 108 replaces the even and odd address registers 32, 34. A hammer address signal is incrementally read from both the set and the reset RAMs during the first half of the option time (read cycle), and a hammer address is stored in both the set and reset RAMs during the second half (write cycle). Thus, both RAMs are simultaneously addressed twice during each option time (once to read out a hammer address and once to store a hammer address) to fire one hammer.

The relationship between the preferred embodiment and the second embodiment may be better understood by way of example. If the even and odd option cycles in the preferred embodiment were each one half as long as the option time in the second embodiment, the first embodiment would "option" hammers twice as often as the second embodiment.

The present invention provides a common control for controlling the individual hammer fire periods to compensate for the inherent differences in individual hammer flight times. The control requires only a few inexpensive, low capacity RAMs to provide control signals which can be decoded and applied to the individual hammer drivers. The invention overcomes the problems and expense associated with the prior art in which each hammer driver required its own delay control circuit for providing the appropriate delays for turning the hammer drivers on and off.

We claim:

1. A method of making the timing of the impact of a set of hammers in an on-the-fly high speed line printer coincide with the alignment of type of a moving type carrier with said hammers, said hammers each having inherent flight times which may differ relative to a predetermined flight time, the method comprising the steps of:

assigning a different hammer address to each of said hammers;

providing stored predetermined time delay values for the respective hammers, each value being related to the actual flight time of a different corresponding one of said hammers such that, when each delay value modifies the time at which its corresponding hammer is fired, the impact of the hammer is timed to occur when the hammer and a type on said type carrier are aligned;

selecting a plurality of hammers to be fired;

storing the addresses of the selected hammers in memory locations of a random access memory means, common to all the hammers, and, for each selected hammer, at a first memory location corresponding to said each selected hammer's predetermined delay value; and sequentially reading out memory locations so that the stored hammer address in each said first memory location is read out to produce a firing pulse for said each selected hammer such that said timing of the impact thereof occurs when the hammer and the type are aligned.

2. A method as defined in claim 1 further comprising the steps of:

providing stored predetermined terminate-firing values for said respective hammers;

storing the address of said each selected hammer in a second memory location corresponding to said each selected hammer's predetermined terminate-firing value; and sequentially reading out memory locations so that the stored hammer address in said each second memory location is read out to produce a terminate-firing pulse to terminate the firing of said each selected hammer at a time defined by its respective terminate-firing value.

3. In a system for making the timing of the impact of a set of hammers in an on-the-fly high speed line printer coincide with the alignment of type of a moving type carrier with said hammers, said hammers each having inherent flight times which may differ relative to a predetermined flight time, the improvement comprising:

a plurality of hammer driver circuits for driving said hammers against said type carrier in response to a hammer fire signal;

hammer select means, coupled in common to all of said hammer driver circuits, for supplying, in response to control signals, a hammer address signal representing a particular hammer to be fired;

circuit means, responsive to said hammer address signal, for supplying a hammer fire signal to the driver circuit of said particular hammer for firing said hammer;

signal generating means for generating an initiate fire signal when said type carrier is properly aligned with said particular hammer; and variable flight time control means, coupled to said hammer select means and to said signal generating means, for generating said control signals in response to said initiate fire signal, said control signals being designated as a first control signal representing the address of said particular hammer and a second control signal representing said timing of the hammer fire signal and of said impact of said particular hammer;

wherein said hammer select means comprises a plurality of set and reset read/write random access memories each having an output port coupled to said circuit means and an input port coupled to said variable flight time control means, and having an address port coupled to said variable flight time control means for selecting the memory locations in which said first control signal is stored and from which said hammer address signal is read, said memory locations representing the timing of the hammer fire signal, and further comprising:

means for storing said first control signal in a set memory location representing a first delay period and in a reset memory location representing a second delay period;

means for subsequently reading said hammer address signal from said set memory location after said first delay period and inputting it to said circuit means which supplies a hammer fire signal to the hammer driver circuit corresponding to said particular hammer; and, means for subsequently reading said hammer address signal from said reset memory location after said second delay period and inputting it to said circuit means which provides a pulse for terminating the hammer fire signal.

4. In a system for making the timing of the impact of a set of hammers in an on-the-fly high speed line printer coincide with the alignment of type of a moving type carrier with said hammers, said hammers each having inherent flight times which may differ relative to a predetermined flight time, the improvement comprising:

a plurality of hammer driver circuits for driving said hammers against said type carrier in response to a hammer fire signal;

hammer select means, coupled in common to all of said hammer driver circuits, for supplying, in response to control signals, a hammer address signal representing a particular hammer to be fired;

circuit means, responsive to said hammer address signal, for supplying a hammer fire signal to the driver circuits of said particular hammer for firing said hammer; signal generating means for generating an initiate fire signal when said type carrier is properly aligned with said particular hammer; and variable flight time control means, coupled to said hammer select means and to said signal generating means, for generating said control signals in response to said initiate fire signal, said control signals being designated as a first control signal representing the address of said particular hammer and a second control signal representing said timing of the hammer fire signal and of said impact of said particular hammer;

wherein said circuit means comprises a plurality of latch means respectively coupled to said hammer driver circuits, and hammer address signal decoder means coupled in common to all of said latch means;

and wherein said hammer select means comprises a plurality of set and reset read/write random access memories each having an output port coupled to said decoder means and an input port coupled to said variable flight time control means, and having an address port coupled to said variable flight time control means for selecting the memory locations in which said first control signal is stored and from which said hammer address signal is read, said memory locations representing the timing of the hammer fire signal; and further comprising:

means for storing said first control signal in a set memory location representing a first delay period and in a reset memory location representing a second delay period;

means for subsequently reading said hammer address signal from said set memory location after said first delay period and inputting it to said decoder means which decodes said hammer address signal and provides a set pulse to a corresponding one of said latch means to supply a hammer fire signal to the hammer driver circuit corresponding to said particular hammer; and means for subsequently reading said hammer address signal from said reset memory location after said second delay period and inputting it to said decoder means which decodes said hammer address signal and provides a reset pulse to said corresponding one of said latch means to terminate the hammer fire signal.

5. The improvement of claim 4, wherein said hammer address signal decoder means further comprises: a first decoder, having a plurality of output terminals coupled to respective ones of said latch means, for providing set pulses; and a second decoder, having a plurality of output terminals coupled to respective ones of said latch means, for providing reset pulses.

6. The improvement of claim 4, wherein an option cycle is defined as the time period in which a hammer may be fired, wherein said plurality of random access memories are divided into an even pair of set and reset memories and an odd pair of set and reset memories, said pairs being alternately addressed during successive option cycles designated as an even cycle and an odd cycle, and wherein during each cycle said hammer address signal is read out of a memory location designated by said second control signal and said first control signal is stored in a memory location designated by said second control signal, said even pair of memories outputting said hammer address signal during said even cycle and storing said first control signal during said odd cycle, and said odd pair of memories reading out said hammer address signal during said odd cycle and storing said first control signal during said even cycle.

7. The improvement of claim 4, wherein an option cycle is defined as the time period in which a hammer may be fired, and wherein said plurality of random access memories comprise a set memory and a reset memory, said memories being simultaneously addressed twice during each option cycle, said option cycle being divided into a read cycle and a write cycle, wherein said hammer address signal is first read out of said set and reset memories during said read cycle, and wherein said first control signal is subsequently stored in said set and reset memories during said write cycle.

8. The improvement of claim 6, said variable flight time control means further comprising:

a hammer address table for providing said first control signal representing the position of each printing hammer, a delay value random access memory for providing a first delay value representing said first delay period between the generation of said initiate fire signal and the firing of each hammer, a clock for providing periodic increment-address-register pulses, address register means for counting said increment-address-register pulses and having output ports for constantly outputting incremented values corresponding to the counted pulses, said output ports being coupled to said even memory address ports during said even cycle and coupled to said odd memory address ports during said odd cycle, said address register means being reset at the beginning of each line print cycle, a terminate fire register for providing a second delay value representing said second delay period between the generation of said initiate fire signal and the termination of hammer firing; and adder means having adder input ports coupled to said address register means, to said delay value random access memory and to said terminate fire register, and adder output ports coupled to said address ports; wherein said adder means adds the current value of said address register means to said first and second delay values, wherein said adder output ports are coupled to said even memory address ports during said odd cycle and are coupled to said odd memory address ports during said even cycle, and wherein the outputs of said adders represent said first and second delay periods.

* * * * *